US005836513A

United States Patent [19]

Smith et al.

[11] Patent Number: 5,836,513

[45] Date of Patent: Nov. 17, 1998

[54] APPARATUS FOR AND METHOD OF MAKING SNOW

[75] Inventors: Warren C. Smith, Marquette, Mich.; William T. Bright, Summersville, W. Va.; Brian L. Johnson, Summersville, W. Va.; Edward James King, Summersville, W. Va.; Vincent L. Ramik, Annandale, Va.

[73] Assignee: Lake Effect Technologies, Inc., Summersville, W. Va.

[21] Appl. No.: 618,770

[22] Filed: Mar. 20, 1996

[51] Int. Cl.[6] ..... F25C 3/04

[52] U.S. Cl. ..... 239/2.2; 239/14.2; 239/394; 239/446; 239/600

[58] Field of Search ..... 239/551, 562, 239/556, 558, 2.2, 14.2, 390, 391, 600, 446, 394

[56] References Cited

U.S. PATENT DOCUMENTS

| | | | |
|---|---|---|---|
| 2,925,222 | 2/1960 | Spreng | 239/77 X |
| 3,278,124 | 10/1966 | Wolford | 239/78 X |
| 3,774,843 | 11/1973 | Rice | 239/14.2 |
| 3,814,319 | 6/1974 | Loomis | 239/14.2 X |
| 3,945,567 | 3/1976 | Rambach . | |
| 3,948,442 | 4/1976 | Dewey . | |
| 3,964,682 | 6/1976 | Tropeano et al. | 239/14.2 X |
| 3,979,061 | 9/1976 | Kircher | 239/14.2 X |
| 4,083,492 | 4/1978 | Dewey . | |
| 4,105,161 | 8/1978 | Kircher et al. . | |
| 4,214,700 | 7/1980 | Vanderkelen et al. . | |
| 4,222,519 | 9/1980 | Kircher et al. . | |
| 4,223,836 | 9/1980 | Eager | 239/14.2 X |
| 4,262,848 | 4/1981 | Chabria | 239/391 X |
| 4,493,457 | 1/1985 | Dilworth et al. . | |
| 4,573,636 | 3/1986 | Dilworth et al. . | |
| 4,593,854 | 6/1986 | Albertsson | 239/14.2 |
| 4,597,524 | 7/1986 | Albertsson . | |
| 4,682,729 | 7/1987 | Doman et al. . | |
| 4,711,395 | 12/1987 | Handfield . | |
| 4,813,598 | 3/1989 | Kosik, Sr. et al. . | |
| 4,823,518 | 4/1989 | Dilworth et al. . | |
| 4,901,920 | 2/1990 | Wollin . | |
| 4,919,331 | 4/1990 | Kosik, Sr. et al. . | |
| 5,031,832 | 7/1991 | Ratnik et al. . | |
| 5,135,167 | 8/1992 | Ringer . | |
| 5,167,367 | 12/1992 | VanderKelen et al. . | |
| 5,180,106 | 1/1993 | Handfield . | |
| 5,322,218 | 6/1994 | Melbourne | 239/2.2 |
| 5,379,937 | 1/1995 | Rothe . | |
| 5,400,966 | 3/1995 | Weaver et al. | 239/2.2 |

FOREIGN PATENT DOCUMENTS

| | | | |
|---|---|---|---|
| 2371649 | 6/1978 | France | 239/14.2 |
| 4295574 | 10/1992 | Japan | 239/2.2 |
| 1312249 | 6/1981 | U.S.S.R. | 239/2.2 |

*Primary Examiner*—Kevin Weldon
*Attorney, Agent, or Firm*—Diller, Ramik & Wight,PC

[57] ABSTRACT

A snow making gun of the present invention includes a cylindrical housing carrying a motor and a fan which creates an air current into which water is injected from a ring water manifold via a plurality of nozzles having discharge orifices. An adjustable nucleating mechanism is associated with the manifold to optimize snow making under a variety of ambient conditions of pressure, humidity and temperature. Preferably, the water manifold or a portion thereof is removable so that nozzles having orifices of the first size can be replaced by an identical water manifold having nozzles whose orifices are of a different size. By utilizing quick connect/disconnect clamping elements a water manifold and its associated nucleating mechanism can be rapidly removed from and another applied to a cylindrical housing of an associated snow gun to assure that optimum artificial snow is made under any and all conditions.

30 Claims, 9 Drawing Sheets

APPARATUS FOR AND METHOD OF MAKING SNOW

BACKGROUND OF THE INVENTION

1. Field of the Invention

The present invention relates to a method of and apparatus for making snow, and in particular to an improved apparatus for rapidly making large quantities of high quality "artificial" snow at low cost and, most importantly, under virtually all ambient conditions, including rapid fluctuations in temperature, humidity and/or pressure.

2. Description of the Related Art

The popularity of winter sports activities, such as downhill and cross country skiing, snow boarding and the like continues to increase, and the availability and quantity of natural snow is often unpredictable and insufficient. Winter sports facilities have historically used artificial snow making equipment to supplement the natural occurring snow fall to build a "base," maintain trails and other ski areas in excellently groomed condition, cover steep, wind blown and/or icy areas, and generally create safer skiing conditions while extending the winter ski season well beyond that which might otherwise occur under only natural snowfall conditions. However, the problem inherent in many prior art snow making machines is the inability thereof to accommodate a variety of different ambient conditions, particularly outdoor temperature and humidity, which might fluctuate rapidly in a short period of time. Thus, a snow making machine or a snow gun which might be optimum under one set of outdoor ambient temperature conditions is far less than optimum under a second set of higher or lower outdoor ambient temperature and/or humidity conditions. Typically, such conventional snow making machines or snow guns are exemplified by structures disclosed in the following prior art patents:

| Patent No: | Patented on: | Inventor(s): |
|---|---|---|
| 3,814,319 | June 4, 1974 | Loomis |
| 3,945,567 | March 23, 1976 | Rambach |
| 3,948,442 | April 6, 1976 | Dewey |
| 3,979,061 | September 7, 1976 | Kircher |
| 4,083,492 | April 11, 1978 | Dewey |
| 4,105,161 | August 8, 1978 | Kircher et al. |
| 4,214,700 | July 29, 1980 | Vanderkelen et al. |
| 4,222,519 | September 16, 1980 | Kircher et al. |
| 4,223,836 | September 23, 1980 | Eager |
| 4,493,457 | January 15, 1985 | Dilworth et al. |
| 4,573,636 | March 4, 1986 | Dilworth et al. |
| 4,597,524 | July 1, 1986 | Albertsson |
| 4,682,729 | July 28, 1987 | Doman et al. |
| 4,711,395 | December 8, 1987 | Handfield |
| 4,813,598 | March 21, 1989 | Kosik, Sr. et al. |
| 4,823,518 | April 25, 1989 | Dilworth et al. |
| 4,901,920 | February 20, 1990 | Wollin |
| 4,919,331 | April 24, 1990 | Kosik, Sr. et al. |
| 5,031,832 | July 16, 1991 | Ratnik et al. |
| 5,135,167 | August 4, 1992 | Ringer |
| 5,167,367 | December 1, 1992 | VanderKelen et al. |
| 5,180,106 | January 19, 1993 | Handfield |
| 5,379,937 | January 10, 1995 | Rothe |
| 5,400,966 | March 28, 1995 | Weaver et al. |

SUMMARY OF THE INVENTION

The snow making gun of the present invention includes a housing internally of which is supported a motor which, when energized, rotates a fan for generating an air current of a substantially uniform and unidirectional path of travel. The housing carries a generally annular or ring-like water manifold which in turn supports a plurality of nozzles and a nucleator mechanism for directing a nucleating air/water admixture toward the air current which at temperatures of approximately 32° F. will create "artificial" snow. Preferably the nozzles of the water manifold have water discharge orifices of a first size which optimize the snow which is made under a first set of ambient conditions of temperature, humidity and/or pressure. However, should temperatures increase or decrease, for example, these orifices would function efficiently only within a relatively limited narrow temperature range. As ambient temperature progressively drops, for example, it would be desirable to direct an increased amount of water into the fan-generated air current. Presently, this is accomplished by manually "cutting-in" additional water nozzles of conventional snow making machines by opening manual valves, but even at this it would be highly desirable to increase the amount of water sprayed by these nozzle orifices into the air current. In keeping with the present invention, this is accomplished by removing one manifold from the snow gun which carries nozzles whose orifices are of a first size and replacing this first manifold with a second identical manifold except the orifices of the nozzles of the second water manifold are of a size differing from the orifices of the nozzles of the first manifold. In this manner, the first manifold has water nozzles provided with small orifices which could be used to make snow at borderline freezing temperatures near or at 32° F., while the second manifold having second nozzles with larger orifices can be used as a "replacement" for the first manifold at temperatures well below 32° F. to inject maximum optimum water from the second manifold larger orifices into the generated air current. Thus, by removing an entire manifold and replacing the removed manifold with a second manifold, the snow gun can accommodate a myriad of temperature, humidity and/or pressure conditions.

In further accordance with the present invention, a housing of the snow making gun is provided with locating holes which receive locating pins carried by the manifolds which effectively orient each water manifold with the housing. This is particularly significant because each manifold also carries an individual nucleating mechanism. Accordingly, by thus accurately locating each manifold relative to the snow gun housing, the associated nucleating nozzle is also accurately located. Furthermore, the nucleating nozzle includes means for adjusting its air/water admixture discharge relative to the predetermined path of travel of the fan generated air current to optimize the impingement angle between the path of the nucleating air/water admixture and that of the fan generated air path to further assure efficient snow making at varying temperatures, humidity and/or pressures. The locating openings and locating pins are preferably positioned diametrically opposite each other for ease of alignment, although this 180° spacing can be varied as, for example, by utilizing three pins and three openings spaced 120° from each other.

The water manifold is also preferably removably secured to the housing by quick connect/disconnect clamping means in the form of a pair of over-center toggle clamps or clamping mechanisms which are also preferably disposed diametrically opposite to each other. The latter construction thereby places the locating openings or apertures and pins and the toggle clamps in alternating relationship about the periphery of the housing and the water manifold which results in the water manifold being firmly clamped against the snow gun housing.

In further accordance with the invention, the path of travel of the fan generated air current is selectively adjusted in both a horizontal and a vertical plane by selectively pivoting or tilting the housing relative to associated pivot axes. This feature is particularly desirable when the snow gun is mounted at an upper portion of a relatively high tower. In this tower-supported embodiment of the snow gun, a lower end portion of the tower includes mechanisms for selectively pivoting the housing about a vertical axis and/or pivoting the housing about a horizontal axis to accommodate the snow gun for virtually all conditions that might be encountered, particularly variations in wind velocity and wind direction.

In accordance with other embodiments of the present invention, instead of removing an entire water manifold and its associated nozzles and first sized orifices and replacing the same with an entire second manifold and its water nozzles of different sized orifices, only a front plate and the nozzles carried thereby need be removed from the water manifold in keeping with another aspect of the present invention. An alternative to this construction is that of mounting the first and second manifolds, each being of an annular or ring-like configuration, concentrically relative to each other, though in this embodiment of the invention only a single air/water nucleating mechanism is carried by the outermost water manifold. A further embodiment of the invention includes a single water manifold in which alternating water nozzles would have different orifice sizes with an appropriate shutter valve mechanism being utilized to selectively open a first set of orifices while closing a second set of orifices and vice versa to accommodate ambient conditions of temperature, humidity and pressure. In another alternative of the water manifold construction, a single water manifold is utilized but a series of Y-shaped conduits are connected by legs thereof to the water manifold while each arm carries a valved water nozzle of different sized orifices.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
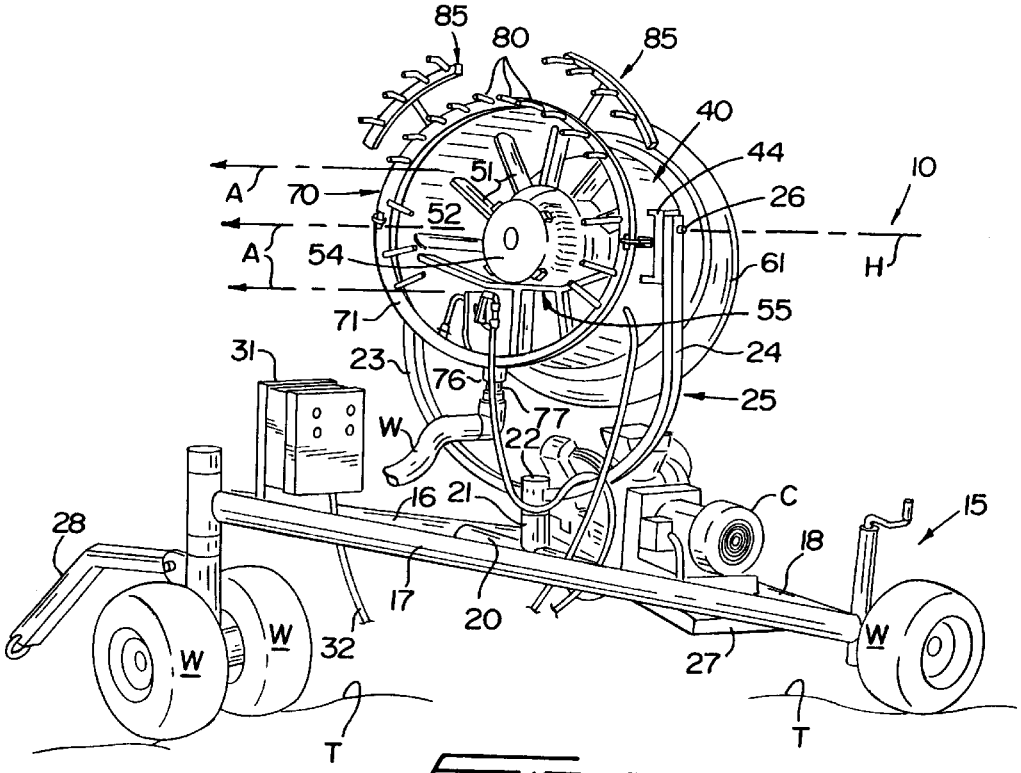
FIG. 1 is a perspective view of a novel snow making machine or snow gun constructed in accordance with this invention, and illustrates a mobile support carrying a cylindrical housing to which is removably secured a water manifold carrying a plurality of nozzles having orifices of a first size.

A novel apparatus for making snow is illustrated in FIG. 1 of the drawings and is generally designated by the reference numeral 10.

The snow making apparatus, snow making machine or snow gun 10 includes means defining a support surface in the form of a mobile support 15 which includes a frame (unnumbered) defined by three metallic tubes 16–18 welded to define a generally triangular configuration, as viewed from above. Another tube 20 spans and is welded to the tubes 16, 17 and includes an upstanding vertical pivot 21 which is received in a downwardly opening blind ended cap 22 to which is welded a pair of arms 23, 24 defining a yoke or bridle 25. Each arm 23, 24 carries a pivot pin or pivot bolt 26.

A frame 27 is welded to the bars 16–18 and carries conventional equipment, such as an air compressor C. Wheels W are conventionally journalled to the frame 15 to permit the snow gun 10 to be pulled over ground or terrain T by a snow "Cat" (not shown) through a conventional hitch 28. Preferably, conventional electrical controls are housed in a water-tight control box 31 which is connected by appropriate wires 32 to a source of electrical power (not shown).

The snow gun 10 includes means 40 (FIG. 2) defining a generally metallic cylindrical housing having a forward end portion 41, a central or medial portion 42 and a rearward portion 43. The medial portion 42 has welded thereto a pair of shallow, generally C-shaped brackets 44 to which the pins or bolts 26 are connected in a conventional fashion to define a horizontal pivot axes H (FIG. 1) of the housing 40. One of the C-shaped brackets 44 includes means 45 (FIG. 2) for selectively adjusting the position of the cylindrical housing 40 relative to the horizontal pivot axis H. The selective adjusting means 45 includes a plurality of holes or apertures 46 formed along an arc of which the axis H is the center. The arm 23 of the yoke 25 has welded thereto a generally C-shaped channel bracket 47 which carries a sliding L-shaped pin 48 which is normally biased by a spring 50 to a position at which an end (not shown and unnumbered) of the pin 48 enters one of the openings or holes 46. When the end of the pin 48 is in one of the holes 46, the housing 40 is prevented from pivoting about the pivot pins 26 and the horizontal axis H, but by manually pulling the pin 46 outwardly of one of the holes 46 against the bias of the spring 50, the housing 40 can be selectively pivoted about the pivot pins 26 and the axis H.

Figure 2:
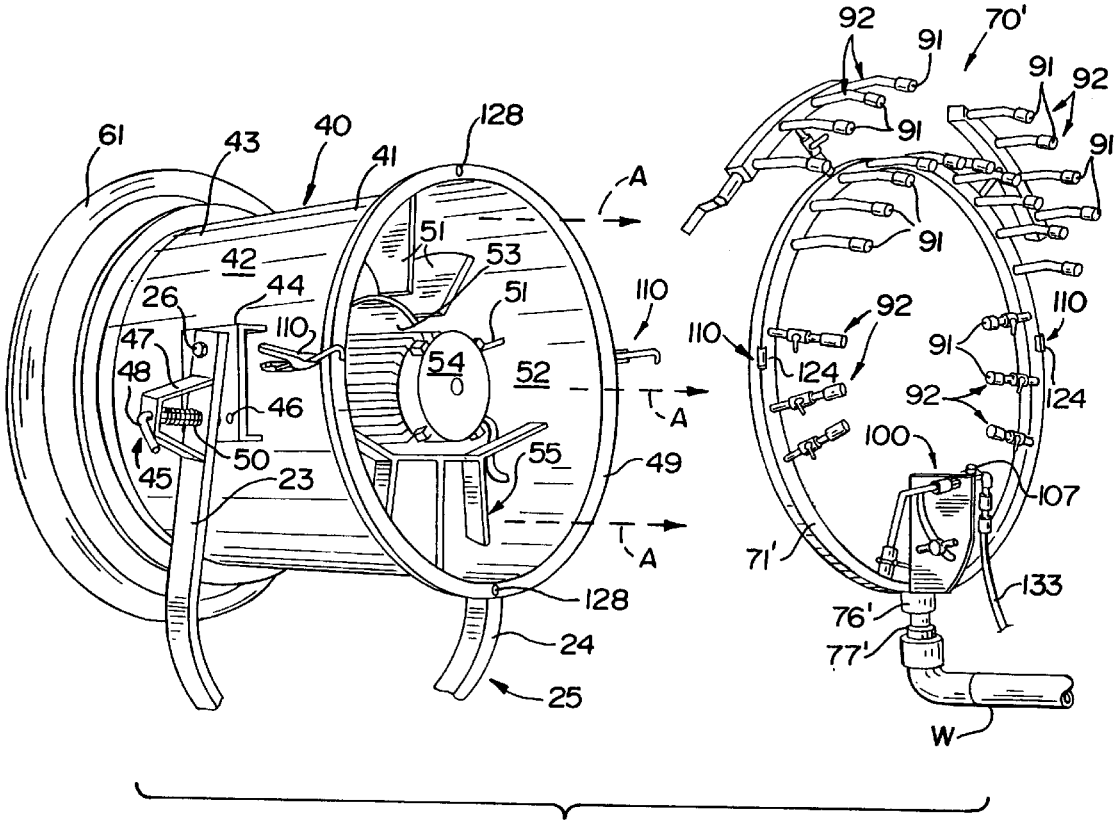
FIG. 2 is a fragmentary exploded perspective view of a portion of the snow gun of FIG. 1, and illustrates the first water manifold removed and a second water manifold having water nozzles whose orifices are of a different size than those of the first water manifold aligned for assembly to the housing of the snow gun.

A plurality of radial brackets 51 (FIGS. 1 and 2) are welded to an interior surface 52 of the housing 40 and to an innermost cylindrical shroud or cylinder 53. The shroud 53 supports an electric motor 54 at one end of the latter, while an opposite end of the motor 54 is supported by a motor support platform 55 (FIG. 2). The motor support platform 55 is simply a plurality of metal plates welded to each other and to the interior surface 52 of the housing 40. The motor 54 preferably includes a housing (unnumbered) which is bolted both to the shroud 53 and to the motor support platform 55. The motor 54 carries a fan (not shown in FIG. 1 but corresponding to the fan 60 of FIG. 8). Upon energization of the motor 54, the fan rotates generating an air current A defining a substantially uniform and unidirectional path of travel which is essentially parallel to the axis (unnumbered) of the cylinder housing 40. The fan draws air through a conventional shroud 61 at the rearward end 43 of the housing 40 and directs the same through the cylindrical housing 40 past the radial brackets 51 and the platform 55 exiting the forward end portion 41 of the housing 40 through an annular or ring-like water manifold 70 (FIG. 1).

The water manifold 70 is the first of at least two and perhaps more manifolds which are essentially identical to each other except for the size of orifices associated with nozzles thereof, as will be described more fully hereinafter. The water manifold 70 is of a generally rectangular hollow cross-sectional configuration, as is best illustrated in FIG. 4 through 7, and includes a water chamber 71 defined by a radially innermost peripheral wall 72, a radially outermost peripheral wall 73, a forwardmost annular or ring wall 74 and a rearwardmost annular or ring wall 75. A fitting 76 is in fluid communication with the chamber 71 and includes a quick connect/disconnect coupling 77 for connection to a water line W for introducing water into the chamber 71. Sixteen primary nozzles, each designated by the reference numeral 80 (FIGS. 1 and 3), are conventionally secured to the forwardmost annular wall 74 of the manifold 70. The lowermost six nozzles 80 each include a manually operable valve (not shown) for individually opening or closing communication between the chamber 71 and each of the orifices 81 thereof. The uppermost ten nozzles 80 exclude such valves and water is free to flow at all times from the water chamber 71 outwardly of the orifices 81 thereof. Two individual secondary manifolds 85 (FIG. 3) carry identical nozzles 80 having orifices 81 and each secondary water manifold 85 is connected by a valved conduit 86 to the manifold 70.

When water under pressure is introduced into the water chamber 71 through the water line W and the fitting 76, it will at all times exit the unvalved ten uppermost nozzles 80 carried by the wall 74 and will be directed thereby in a generally acute angle (not shown) into the air current or air stream A resulting in the formation of "artificial" snow at outdoor ambient temperatures of 32° F. and below in conjunction with or absent means 100 for creating a nucleating admixture of air/water which will be described more fully hereinafter. Depending upon ambient conditions, particularly ambient outdoor temperature, any one or all of the lowermost six primary valved nozzles 80 can be opened or closed and either or both of the secondary nozzles 80 associated with the secondary manifolds 85 can be opened or closed. It will be assumed that the orifices 81 associated with the primary and secondary nozzles 80 are all of the same size and are relatively small which will render the operation of the manifold 70 most efficient under borderline freezing (32° F.) temperature conditions. Quite simply, when the temperature is slightly above or borderline freezing (32° F.), most efficient snow can be made with a relatively fine stream of water being emitted from the orifices 81 into the air current A. Thus, at relatively high temperatures, water emanating from the orifices 81 in the form of a fine "mist" or a misty stream will freeze more rapidly than would droplets which might be more "coarse" or larger in size, yet larger water particles or droplets would be far more efficient and optimum at temperatures well below 32° F. Accordingly, though the manifold 70 and the small orifices 81 of the nozzles 80 might prove most efficient at marginal snow making temperature conditions (32° F. and slightly above), the efficiency of the snow gun 10 is inherently diminished because of the lack of sufficient water exiting the small orifices 81 of the nozzles 80 even when all nozzles 81 are functioning.

Accordingly, in keeping with the present invention a second water manifold 70' (FIG. 2) is provided which is identical to the first water manifold 70 except for orifices 91 of nozzles 92. Thus, the second water manifold 70' has been provided with identical though primed reference numerals to identify the structure thereof which corresponds to the identically, though unprimed, structure of the first manifold 70. In lieu of the orifices 81 of relatively small size, the orifices 91 of nozzles 92 are of an appreciably larger size. Thus, the water manifold 70' is specifically intended for utilization at very low temperatures below 32° F. when relatively coarse streams of water can issue from the larger orifices 91 into the air current A to freeze and create snow therefrom. Thus, if the snow gun 10 is operating in conjunction with the first water manifold 70 under marginal snow making conditions (borderline freezing), and a rapid temperature drop occurs, as is not uncommon, the manifold 70 is simply removed from the housing 40, in the manner to be described immediately hereinafter, and is replaced by the manifold 70'. This merely requires the quick uncoupling and recoupling provided by the couplings 77, 77' with attendant brief water cut-off, de-energization of the compressor C, etc.

Figure 3:
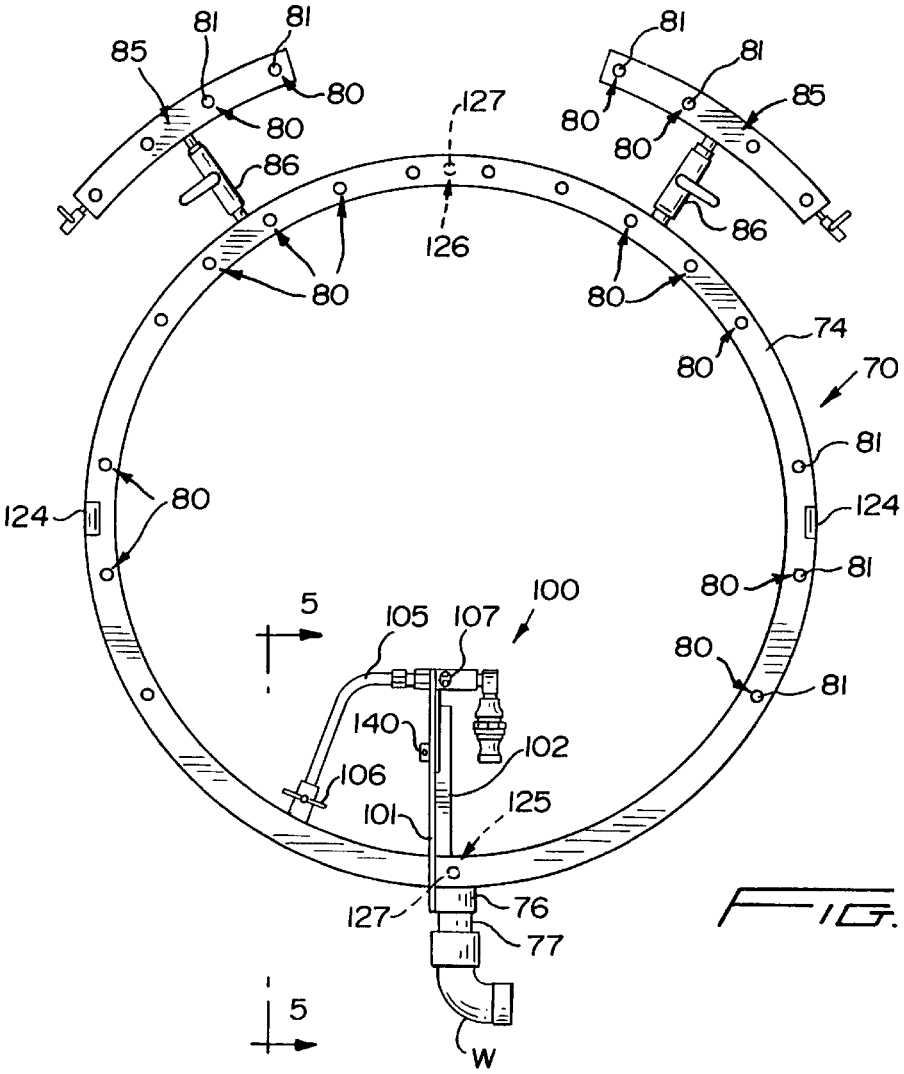
FIG. 3 is a front elevational view of the first water manifold of FIG. 1, and illustrates details thereof including an adjustable nucleating mechanism for directing an admixture of air/water toward an air current generated by a fan of the snow gun.

In order to achieve rapid assembly and disassembly of the manifolds 70, 70' relative to the housing 40 quickly and absent the use of tools, the housing 40 is provided with identical diametrically opposite means 110 (FIGS. 2, 6 and 7) for removably clamping or securing each of the manifolds 70, 70' relative to an annular angular wall 49 (FIG. 5) welded to the forward end portion 41 of the housing 40. Each of the water manifold securing means 110 includes an over-the-center toggle clamp 111 defined by a lever 112 having a handle portion 113 opposite of which a hook 114 is connected by a pivot pin 115. A yoke bracket 116 is pivoted by a pin 117 to the lever 112 and receives through an opening (unnumbered) thereof a threaded eye bolt 118 carrying a nut 120 at one end and an eye 121 at an opposite end hooked in an opening 122 of a bracket 123 welded in an upstanding fashion to the forward end portion 41 of the housing 40. The hook 114 cooperates with and is contoured to embrace a cylindrical clamping segment 124 welded to each of the water manifolds 70, 70' at diametrically disposed locations, as is best illustrated in FIGS. 2 and 3 of the drawings. Either manifold 70, 71' is positioned with its innermost annular wall 75 against the wall 49 of the forward end portion of the housing 40, as is best illustrated in FIGS. 1, 5, 6 and 7 of the drawings. Each hook 114 is then placed into alignment with its cylindrical clamping segment 124 and the handle portion 113 is moved from the position shown in FIG. 7 to the locking or clamping position shown in FIG. 6. The two clamping means 110 thereby impart forceful diametrically opposite clamping forces to either of the water manifolds 70, 70' associated with the housing 40.

In order to assure that either of the manifolds 70, 70' is accurately located relative to the housing 40, each of the water manifolds 70, 70' carries diametrically disposed locating means 125, 126 in the form of a locating pin 127 located at the 12 and 6 o'clock positions of the rearwardmost annular wall 75 and locating holes or apertures 128 located at like 12 o'clock and 6 o'clock positions of the plate 49 of the housing 40. The pins 127 are inserted in the holes or openings 128 to achieve accurate alignment of either of the water manifolds 70, 70' prior to the locking or clamping of the over-the-center toggle clamps 111 in the manner earlier described. Thus, the locating means 125 and the clamping means 110 are in alternating relationship to each other and assure precise location and intimate clamping of either manifold 70, 70' relative to the housing 40.

Figure 4:
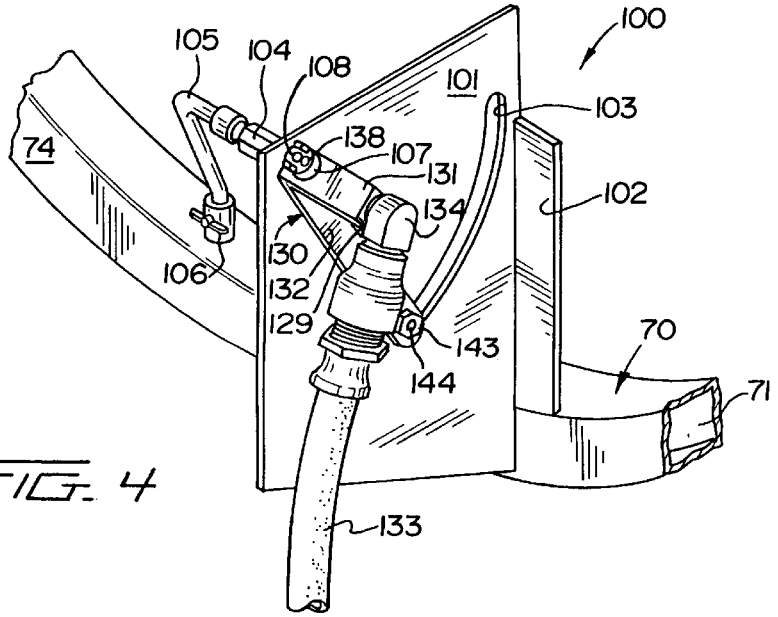
FIG. 4 is a fragmentary enlarged perspective view of a lower portion of the water manifold of FIG. 3, and illustrates details of the adjustable nucleating mechanism.
Figure 5:
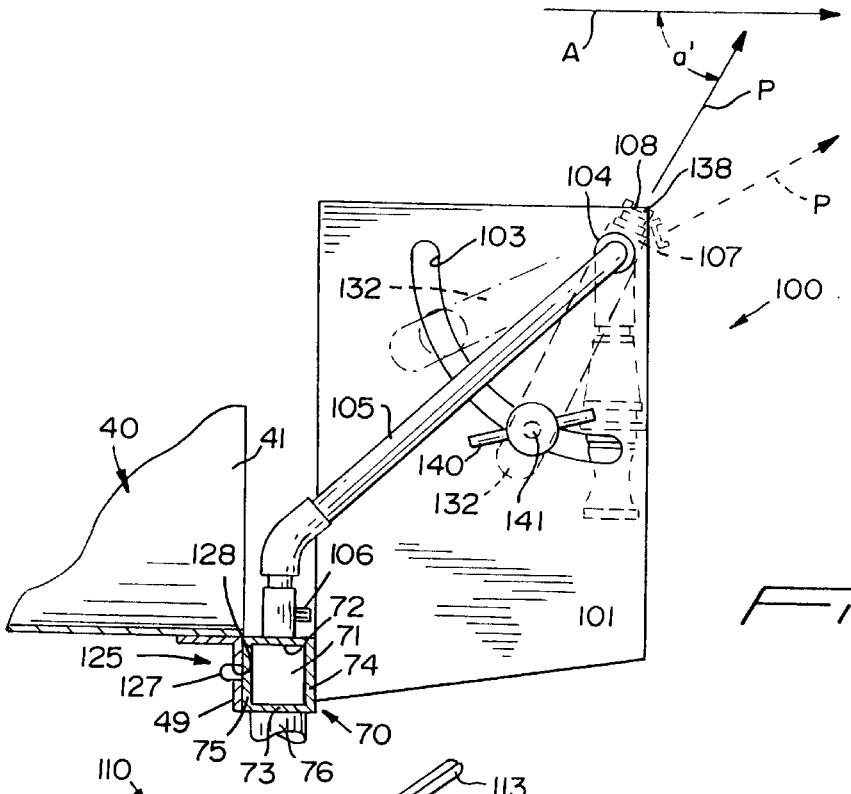
FIG. 5 is an enlarged cross-sectional view taken generally along line 5—5 of FIG. 3, and illustrates the manner in which a nucleating nozzle of the nucleating mechanism is selectively adjusted to alter the angle of impingement between a predetermined path of travel of the nucleating air/water admixture and the fan generated air current, and a locating pin of the water manifold received in a locating opening of the housing.
Figure 6:
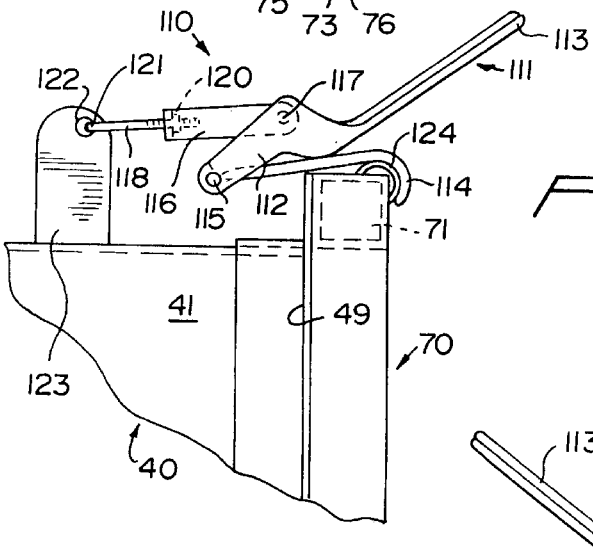
FIG. 6 is a fragmentary side elevational view of a portion of the housing and water manifold, and illustrates an over-the-center toggle clamp for removably clamping either of the two water manifolds to the snow gun housing.
Figure 7:
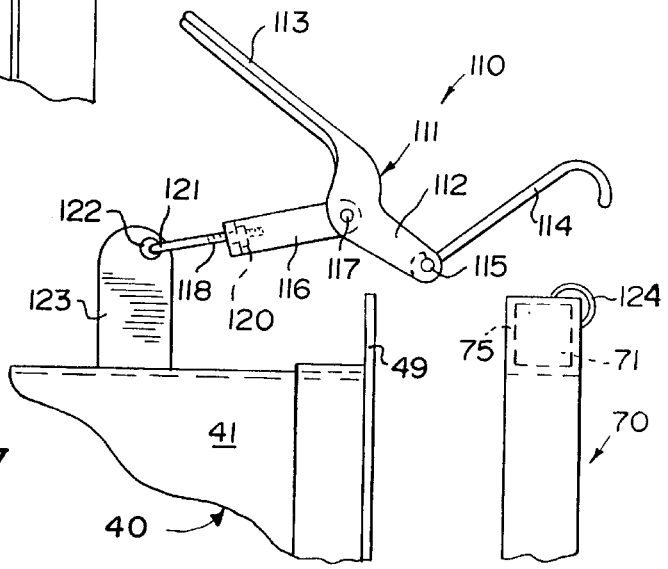
FIG. 7 is a fragmentary side elevational view similar to FIG. 6, and illustrates the over-the-center toggle clamp in its unclamped position.

Reference is made to FIGS. 3 through 5 of the drawings and the air/water nucleating means 100 for providing an air/water admixture which is injected toward and into the air current A along a predetermined path of travel P (FIG. 5) from a position generally somewhat above the 6 o'clock position of the manifold 70, as is most readily apparent from FIGS. 1 and 3 of the drawings. The nucleating means or nucleating mechanism 100 includes a pair of vertically upstanding plates 101, 102 which are welded to each other and to the manifold wall 74. The plate 101 includes an arcuate slot 103 and a hole (unnumbered) in which is rotatably journalled a tubular journal 104 which is free to rotate relative to both the plate 101 and a water pipe 105 which is fluid communication with the water chamber 71 of the water manifold 70 via a manual control valve 106 (FIG. 4). Water from the water chamber 71 is thereby delivered to a nozzle 107 and exits therefrom via a water orifice 108. The nozzle 107 is fixed to an arm 131 of a bracket 130 which includes a leg 132 which can rotate with the tubular journal 104 and is parallel to a shorter arm 29. An air hose 133 is connected to a fitting 134 which passes freely through a bore (not shown) in the shorter arms 129 and is connected to the nozzle 107 with air exiting from the latter via an air orifice 138. The hose 133 is, for example, connected to the compressor C (FIG. 1) and thus as the water and air are sprayed into the atmosphere along the path of travel P (FIG. 5) via the respective orifices 108, 138, the admixture of air/water forms nuclei or seeds which enter the air current A and admix with the water injected therein via the nozzle orifices 81, 91. The two paths A, P (FIG. 5) define an acute angle a' therebetween which in further accordance with the present invention can be varied by adjusting the predetermined path P of the air/water nucleating admixture spray by rotating the nozzle 107 and locking the same in any one of a plurality of selected positions of adjustment. This adjustment is achieved by loosening a handle 140 (FIG. 5) which includes a shaft 144 having a threaded end portion 142 which passes through the slot 103, an opening (unnumbered) in the leg 132, and is threaded to a nut 143. When the nut 143 is loose, the bracket 130 is rotated with the journal 104 which rotates the nozzle 107 between the limits established by the blind ends (unnumbered) of the slot 103. Once a desired angle a' is achieved, as is dictated by ambient conditions, the handle 140 is tightened to thread the threaded end portion 144 relative to the nut 143 to hold the nozzle 107 in this desired adjusted position. As ambient conditions change, the angle a' of the predetermined path P of the nucleating admixture spray can be readily and quickly adjusted to the path A to vary the angle a' therebetween.

Another snow making machine or snow gun constructed in accordance with this invention is illustrated in FIGS. 8 through 12 of the drawings and is generally designated by the reference numeral 10'. The snow gun 10' is essentially identical to the snow gun 10 except for two particulars, namely, (a) the mobile support 15 of the snow gun 10 (FIG. 1) is instead a fixed support defined by a conventional concrete base 150 upon which is supported a tower 151 and (b) the selective adjusting means 45 (FIG. 1) of the snow gun 10 at the cylindrical housing 40 has been eliminated and such adjustment is instead achieved by selective adjusting means 160 which includes a linkage 161 (FIG. 11) operative from a lower end portion 152 of the tower 151 to pivot the housing 40' (FIG. 11) about a pivot pin 26' which pivotally connects the housing 40' to arms 23', 24' of a yoke 25'. The yoke 25' is welded to and supported by an upper end portion (unnumbered) of a tubular column 154 which is journalled for rotation about a vertical axis through aligned journals 161–164 carried by respective support brackets 165–168 welded to and supported by the tower 151. Rotation of the tubular column 154 about its vertical axis imparts similar rotation to the yoke 25' and the housing 40' to thereby effect selective adjustment of an air current path of travel A' (FIGS. 9 and 11) in a horizontal plane.

Figure 10:
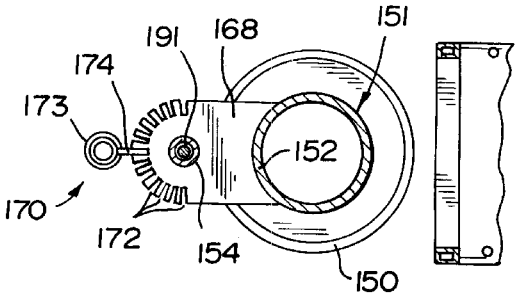
FIG. 10 is an enlarged cross-sectional view taken generally along line 10—10 of FIG. 8, and illustrates a mechanism for rotating the snow gun housing about a vertical axis.
Figure 11:
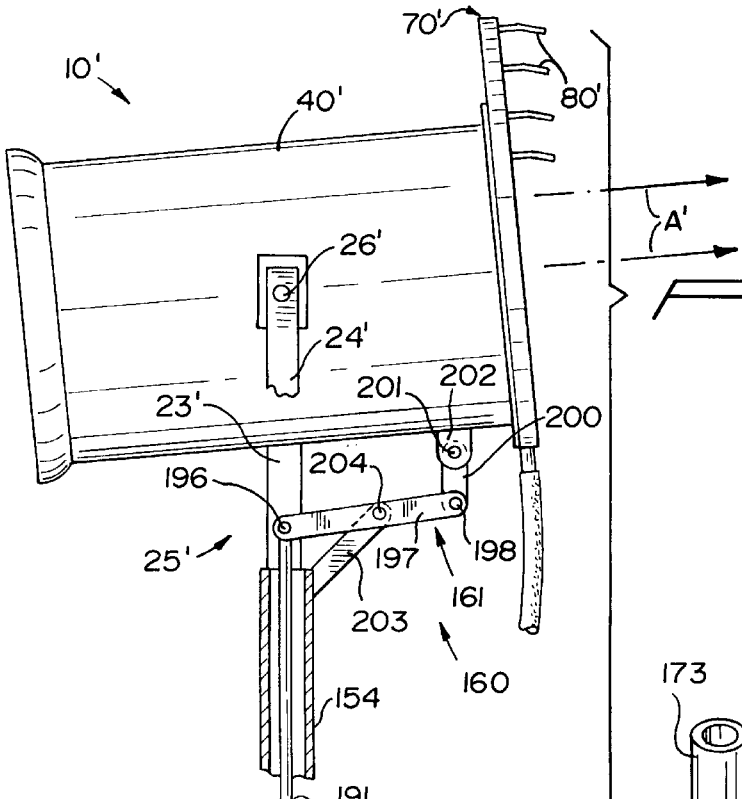
FIG. 11 is an enlarged fragmentary vertical cross-sectional view of the snow making gun of FIGS. 8 and 9, and illustrates details of the mechanisms for selectively adjusting the housing and thus the air current path of travel relative to both horizontal and vertical planes.
Figure 12:
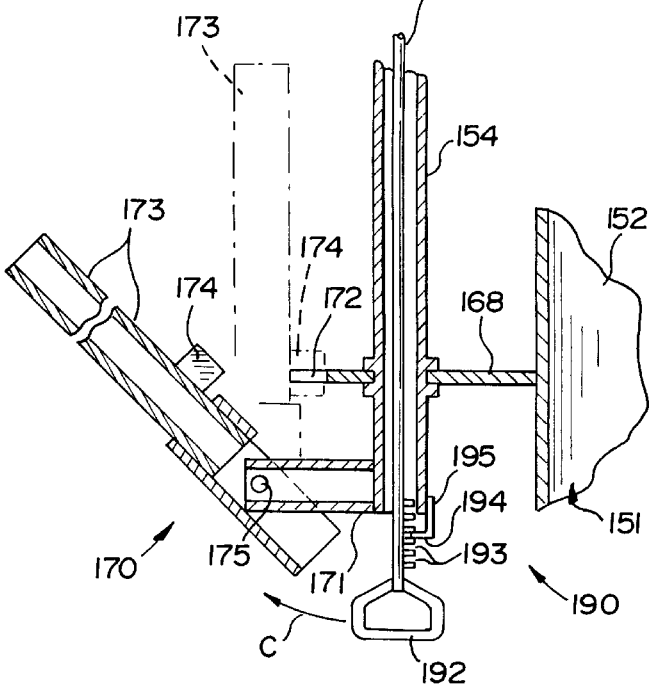
FIG. 12 is an enlarged fragmentary perspective view of the lower portion of the mechanisms illustrated in FIG. 11, and illustrates further details thereof, including a slotted sector or plate for selectively locking the snow making gun housing in one of several positions of its adjustment about a vertical axis.
Figure 12:
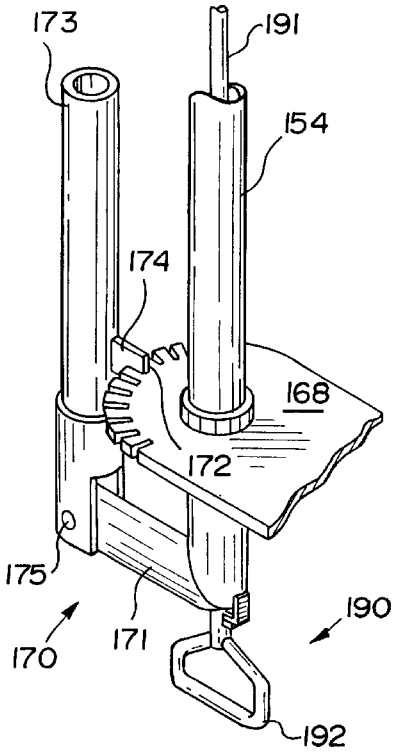

Means generally designated by the reference numeral 170 (FIGS. 8, 10 and 11) is provided adjacent the lower end portion 152 of the tower 151 for effecting the rotation of the tubular column 154. The adjustment effecting means or mechanism 170 includes a short tube 171 (FIG. 11) welded to a lower end (unnumbered) of the tubular column 154 beneath the bracket 168 which in turn includes a plurality of arcuately disposed slots 172 (FIG. 10). A handle 173 carrying a narrow plate 174 is pivotally connected by a pivot pin 175 to the short tube 171. In the phantom outline position of the handle 173 illustrated in FIG. 11 and in the solid outline position of FIG. 12 the plate 174 is shown engaged in one of the slots 172 which prevents the column 154 from rotating and thus maintains the housing 40' in a desired position of adjustment about a vertical axis which in turn permits selectively "aiming" or directional orientation of the air stream A' in a generally horizontal plane. Accordingly, by moving the handle 173 from the phantom outline position shown in FIG. 11 to the solid position shown therein, the column 154 can be manually rotated clockwise or counterclockwise to "aim" the housing 40' in an appropriate direction so that the generated air current path A' is similarly directed as is required, after which the handle 173 is again moved to the solid outline position shown in FIG. 12 to lock the housing 40' in the selected position by the short plate 172 engaging in the desired selected notch 172. In the vertical position of the handle 173 the handle 173 "leans" slightly toward or is inclined slightly toward the tubular column 154 and is thereby held by gravity in its vertical "locked" position. In conjunction with the latter or as an alternative thereto a conventional spring can be utilized to bias the handle 173 to the "locked" position (FIG. 12) in an obviously conventional manner.

Means generally designated by the reference numeral 190 (FIG. 11) are also provided for selectively adjusting the housing 40' for pivoting movement about the axis H' (FIG. 8) of the pivots 26' via the linkage 161. The means 190 include an actuator rod 191 having a lowermost handle 192 and a plurality of vertically spaced slots 193 which selectively receive a horizontal leg or ledge 194 of a bracket 195 which is weld to a lower end (unnumbered) of the tubular column 154. The rod 191 is connected at an upper end (unnumbered) by a pivot pin 196 to one end of an arm 197 of the linkage 161 which is in turn connected at its opposite end by a pivot pin 198 to a short arm 200. The short arm 200 is connected by a pivot pin 201 to a bracket 202 welded to a lower portion (unnumbered) of the housing 40'. A bracket 203 is welded to an upper end (unnumbered) of the tubular column 154 and is in turn connected by a pivot pin 204 to the arm 197. In order to pivot the housing 40' about the pivots 26' and thus the axis H', the handle 192 is grasped and pivoted counterclockwise about the pivot 196 which is to the left in FIG. 12, as is indicated by the arrow C. This frees the ledge 194 from its associated slot 193 after which the actuated rod 191 can be pushed up or pulled down which achieves respective clockwise and counterclockwise rotation of the housing 40' about the pivots 26', as viewed in FIG. 11, to thereby vary the path of the air current A' in a vertical plane. Accordingly, because of the selective adjustment means 160, 170 and the associated manual manipulation thereof, the air stream A' and the water injected therein via the nozzles 80, 92 can be oriented virtually in any desired direction selectively in both horizontal and vertical planes.

Figure 13:
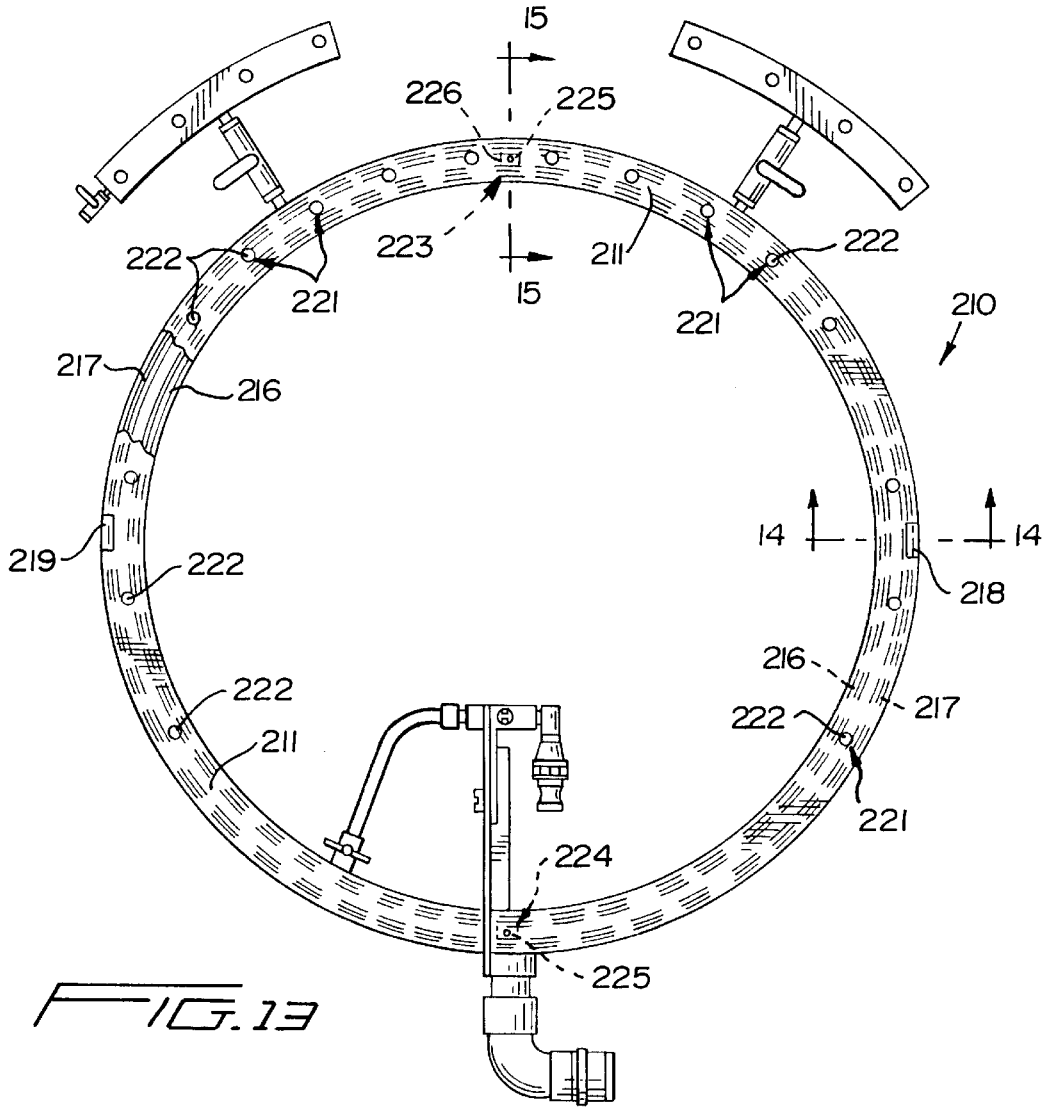
FIG. 13 is a front elevational view of another water manifold similar to that illustrated in FIG. 3, and illustrates a plurality of nozzles carried by a front annular water manifold wall or plate which is removable from and sealed relative to a rear water manifold channel or housing.
Figure 14:
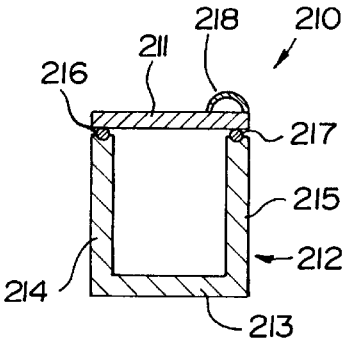
FIG. 14 is an enlarged cross-sectional view taken generally along line 14—14 of FIG. 13, and illustrates the manner in which the front annular water manifold wall or plate is clampingly held in sealing contact against two annular seals carried by the water manifold channel.
Figure 15:
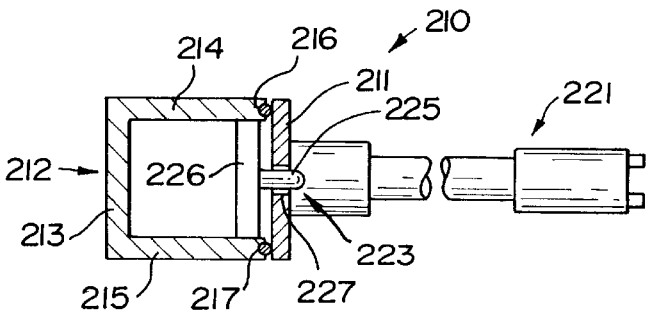
FIG. 15 is an enlarged cross-sectional view taken generally along line 15—15 of FIG. 13, and illustrates one of two diametrically opposite locating pins carried by the water manifold channel which registers with an associated locating opening in the front annular plate.

Another water manifold constructed in accordance with this invention which is similar to the water manifold 70, 70' is illustrated in FIGS. 13 through 15 of the drawings and is generally designated by the reference numeral 210.

The water manifold 210 is of a generally annular or ring-like configuration and is defined by a front annular wall or plate 211 and a rear water manifold channel or housing 212 which is defined by a bight wall 213 and two generally parallel spaced walls 214, 215, each of which ends in a free terminal edge (unnumbered) carrying respective O-ring seals 216, 217. Diametrically opposite clamping segments 218, 219 are carried by the front annular plate 211. The front annular plate 211 also carries sixteen water nozzles 221 each having a discharge orifice 222 of a specific size. Locating means 223, 224 corresponding to the like locating means 125, 126 of the water manifold 70, are positioned diametrically opposite each other at the respective 12 o'clock and 6 o'clock positions, and each includes a locating pin 225 welded to and projecting from a relatively narrow bridging plate 226 spanning and welded to the walls 214, 215 of the manifold channel 212, as is readily apparent in FIG. 15. The locating means 223, 224 also include a circular locating opening 227 formed in the front annular plate 211 at the 12 o'clock and 6 o'clock positions which registers each of the pins 225 of the locating means 223, 224.

The water manifold channel or housing 212 is welded or otherwise rigidly and permanently attached to a snow gun housing, such as the housings 40, 40'.

The secondary manifolds (unnumbered) and associated valve conduits (unnumbered), the nucleating means (unnumbered) and the adjustment mechanism therefor (unnumbered) shown in FIG. 13 are assembled only to the water manifold housing 212, and this permits the front annular plate 211 to be bodily removed from and/or relocated upon the manifold housing 212. Thus, assuming that the discharge orifices 222 of the sixteen spray nozzles 221 carried by the front annular plate 211 are relatively small and are used for marginal temperature snow-making conditions, should outdoor ambient air temperature drop to 32° F. or well below, it is desirable to, obviously, remove the front annular plate 211 and the nozzles 221 and replace the same with another identical front annular plate (not shown) and nozzles (not shown) differing only in providing larger water discharge orifices therein. Thus, the water manifold 210 is somewhat simplified as compared to the water manifolds 70, 70' from the standpoint of only requiring that the front annular plate 211 and the associated nozzles 212 be removed and replaced for varying snow making conditions.

Figure 16:
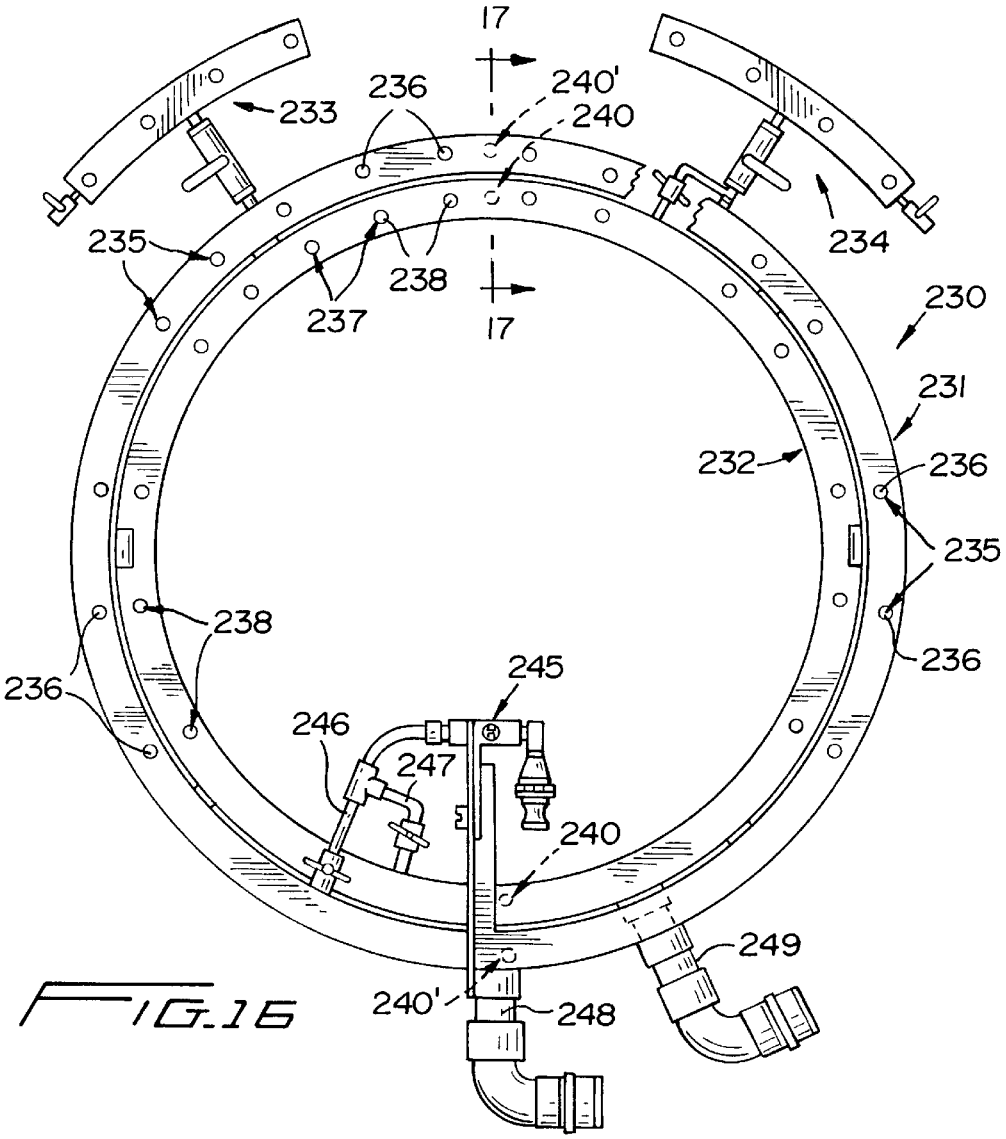
FIG. 16 is a front elevational view of another water manifold similar to the water manifolds illustrated in FIGS. 3 and 13, and illustrates an inside water manifold concentric relative to an outside water manifold with each water manifold having a separate valved water inlet and each carrying nozzles having different size spray orifices.
Figure 17:
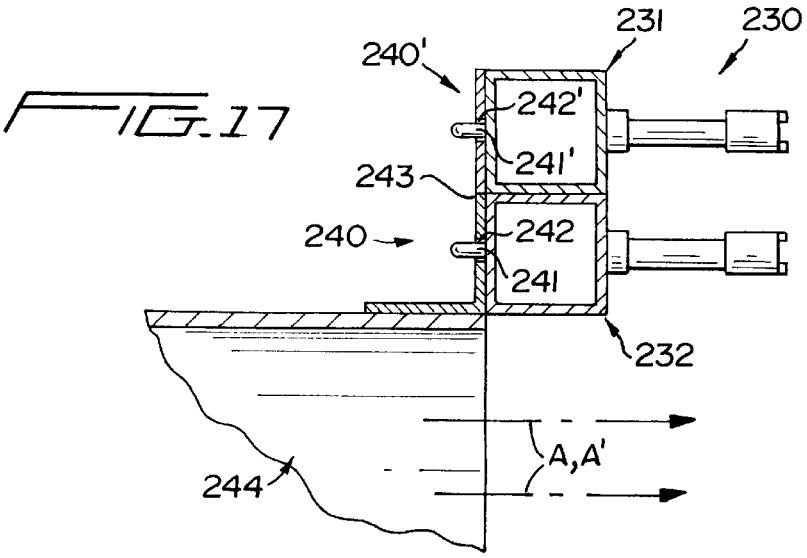
FIG. 17 is an enlarged cross-sectional view taken generally along line 17—17 of FIG. 16, and illustrates the concentric relationship of the water manifolds and a locating pin carried by the inside water manifold registering with a locating opening of an associated water gun housing.
Figure 18:
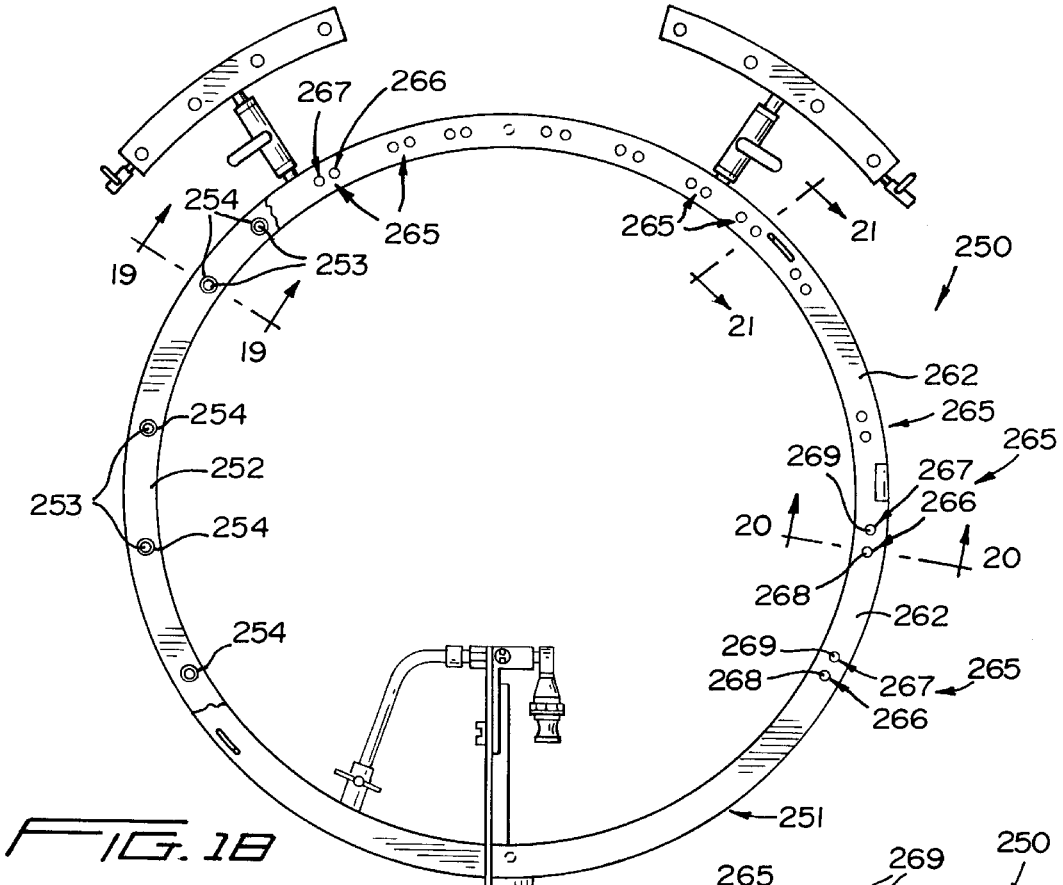
FIG. 18 is a front elevational view with a portion thereof broken away for clarity of another water manifold similar to the water manifolds of FIGS. 3, 13 and 16, and illustrates a plurality of adjacent pairs of water nozzles carried by a front annular water manifold wall or plate which is rotated relative to a water manifold housing to selectively register either water nozzle of each pair of water nozzles with an underlying opening of the water manifold housing upon selective rotation of the front annular water manifold plate.
Figure 19:
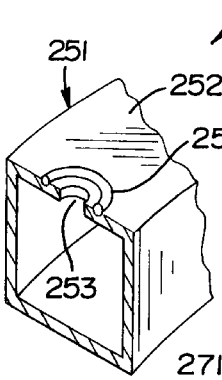
FIG. 19 is an enlarged cross-sectional view taken along line 19—19 of FIG. 18, and illustrates an O-ring seal encircling each circular opening of the water manifold housing.
Figure 21:
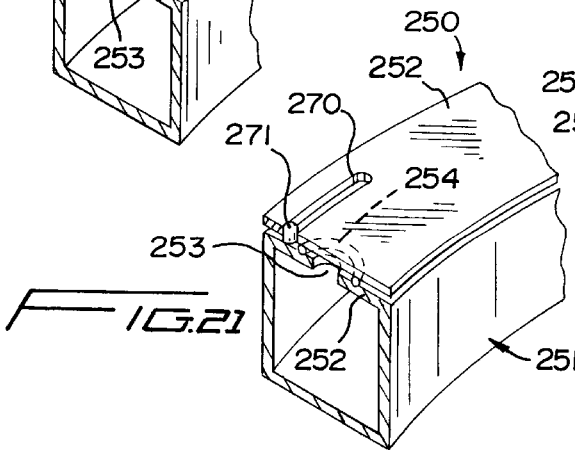
FIG. 21 is an enlarged cross-sectional view taken generally along line 21—21 of FIG. 18, and illustrates one of a pair of pins each of which bottoms against blind ends of an arcuate slot in the front annular water manifold plate to register the water nozzles selectively with the circular openings of the water manifold housing.
Figure 20:
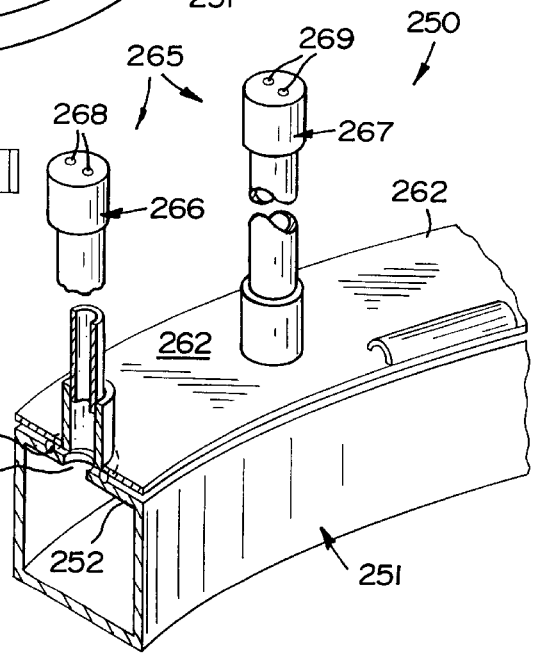
FIG. 20 is an enlarged cross-sectional view taken generally along line 20—20 of FIG. 18 and illustrates one water nozzle of one of the pair of water nozzles in fluid communication with an associated circular opening of the water manifold housing for discharging water spray through the orifices thereof.

Another water manifold constructed in accordance with this invention is illustrated in FIGS. 16 and 17 of the drawings, and is generally designated by the reference numeral 230.

The water manifold 230 includes a first outside or outer annular water manifold 231 and a second inner or inside annular water manifold 232 which is in concentric relationship to the outer water manifold 231.

The outer manifold 231 carries a pair of valved secondary manifolds 233, 234 (FIG. 16) identical to the secondary manifolds heretofore described, such as the secondary manifolds 85 (FIG. 3). The outer manifold 231 includes sixteen primary water nozzles 235 having water discharge spray orifices 236 and the inner water manifold 232 similarly includes sixteen primary water nozzles 237 having discharge spray orifices 238. The orifices 236 of the nozzles 235 are preferably larger than the orifices 238 of the nozzles 237.

Locating means 240, 240' (FIGS. 16 and 17) are associated with the inner water manifold 232 and the outer water manifold, respectively, and each includes a locating pin 241, 241' at the 12 o'clock and 6 o'clock positions of the inner and outer water manifolds 231, 232 which are received in locating openings 242, 242' of a plate 243 carried by a housing 244 corresponding to the housings 40, 40' heretofore described.

Air/water nucleating means 245 identical to the nucleating means or mechanisms 100 is carried by the water manifolds 231, 232 at substantially the 6 o'clock position and is supplied water through valved lines 246, 247 from the respective water manifolds 231, 232. Water from the source (not shown) is supplied to the water manifolds 231, 232 through respective conduits and fittings 248, 249.

Under marginal temperature conditions (borderline 32° F.), water is supplied via the conduit, pipe or fitting 249 to only the inner water manifold 232 with the valved line or pipe 246 being closed and the valve line or pipe 247 being open which injects a fine mist into the air current A or A' via the small discharge spray orifices 238 of each of the nozzles 237. An air/water nucleating spray also enters the same air current A, A' and collectively these water sprays create artificial snow in the manner heretofore described under marginal snow making temperature conditions.

Should temperatures reach 32° F. and below, more water can be supplied to the air current A or A', and this is preferably done by preventing water flow to the inner water manifold 232 by appropriately closing a valve (not shown) associated with the conduit 249. Water is supplied to the outer water manifold 231 by opening a valve (not shown) associated with the conduit 248. Water from the manifold 231 flows through the now opened valve conduit 246 and exits as a nucleating spray from the nucleating mechanism 245 while, of course, the valved line 247 is closed. Spray now exits the larger orifices 236 of the nozzles 235 of the outer manifold 231 and is injected into the air current A, A'. At this point, the valved secondary manifolds 233, 234 can be operative or not, as conditions dictate.

The water manifold 230 thereby permits each of the manifolds 231, 232 to be operated individually, as temperature/humidity/pressure conditions dictate. However, the advantage of the water manifold 230 is, of course, that neither water manifold 231, 232 need be removed and/or replaced or either can be removed and/or replaced relative to its associated housing (40 or 40', for example). Therefore, though the initial costs of the equipment might be higher because of the "duplication" of the water manifolds, in the long run the water manifold 230 might prove commercially more attractive for certain snow making applications, particularly because an additional water manifold(s) can be substituted for either or both of the water manifolds 231, 232.

It should be further noted that because the inner manifold 232 carries the nozzles 237 with the smaller orifices 238, the finer spray issuing therefrom is more immediately adjacent the air current A or A', as compared to the heavier spray issuing outwardly from the larger orifices 236 of the nozzles 235. Thus, the finer spray issuing from the smaller orifices 238 can enter the air current A, A' immediately absent undesired dispersion and is carried along thereby for a longer distance to generate more snow under marginal temperature conditions. Accordingly, the benefit thus provided by having the smaller orifices 238 of the nozzles 237 more adjacent to the air currents A, A' is a preferred embodiment of the invention, but obviously the nozzles 235, 236 can be interchanged and the resulting structure is considered to fall within the scope of the invention.

Another novel water manifold constructed in accordance with this invention is illustrated in FIGS. 18 through 21 of the drawings and is generally designated by the reference numeral 250.

The water manifold 250 includes a water manifold housing 251 of a generally annular or ring-like configuration corresponding to the manifolds heretofore described. A first annular front wall or plate 252 (FIGS. 18 and 19) of the water manifold housing 251 is provided with sixteen circular openings 253 each surrounding an O-ring seal 254. The location of the circular openings 253 correspond to the locations of the primary nozzles of the various primary water manifolds heretofore described.

A second annular front wall or plate 262 (FIGS. 18, 20 and 21) corresponds in shape, size, etc. to the first annular front wall 252, and is adapted to be rotated relative thereto about a central axis (unnumbered) of the water manifold housing 251. The second movable annular front plate 262 includes sixteen pairs 265 of spray nozzles 266, 267 each having respective smaller discharge orifices 268 and larger discharge orifices 269. The distance between the axes of the nozzles 266, 267 of each pair 265 of nozzles is the same and corresponds to the distance between blind ends (unnumbered) of an arcuate slot 270 (FIG. 21) located generally at the 2 o'clock and 8 o'clock positions of the second rotatable annular front wall 262. A pin 271 carried by and projecting from the first annular front wall 252 at the 2 o'clock and 8 o'clock positions projects into each of the arcuate slots 270. When the pins 271 bottom against one blind end of its arcuate slot 270, each nozzle 266 registers with one of the circular openings 253 while the bottoming of the pins 271 with the opposite blind ends of the slots 270 aligns each of the nozzles 267 with one of the circular openings 253. Each O-ring seal 254 assures that the water which flows from the water manifold housing 251 through each opening 253 will flow only into the nozzle associated therewith. Accordingly, in one arcuate position of the plate 262 relative to the plate 252, the discharge orifices 268 will be operative while the discharge orifices 269 will be inoperative, and vice versa.

The second annular front plate 262 is locked or clamped securely to the first annular front plate 252 in either of the two positions of arcuate adjustment by utilizing clamping mechanisms corresponding to the clamping mechanisms 110 (FIGS. 6 and 7), each being associated with diametrically oppositely positioned cylindrical clamping segments 274 corresponding to the clamping segments 124 but being of greater arcuate extent to assure that the hooks 114 of the clamping mechanisms 110 will firmly lock thereagainst in either of the two relative positions of arcuate adjustment of the second movable annular front plate 262. Accordingly, by simply unclamping the locking mechanisms 110 and rotating the second annular front wall 262, either of the discharge orifices 268, 269 of the respective nozzles 266, 267 can be placed in operation depending upon ambient conditions.

Figure 22:
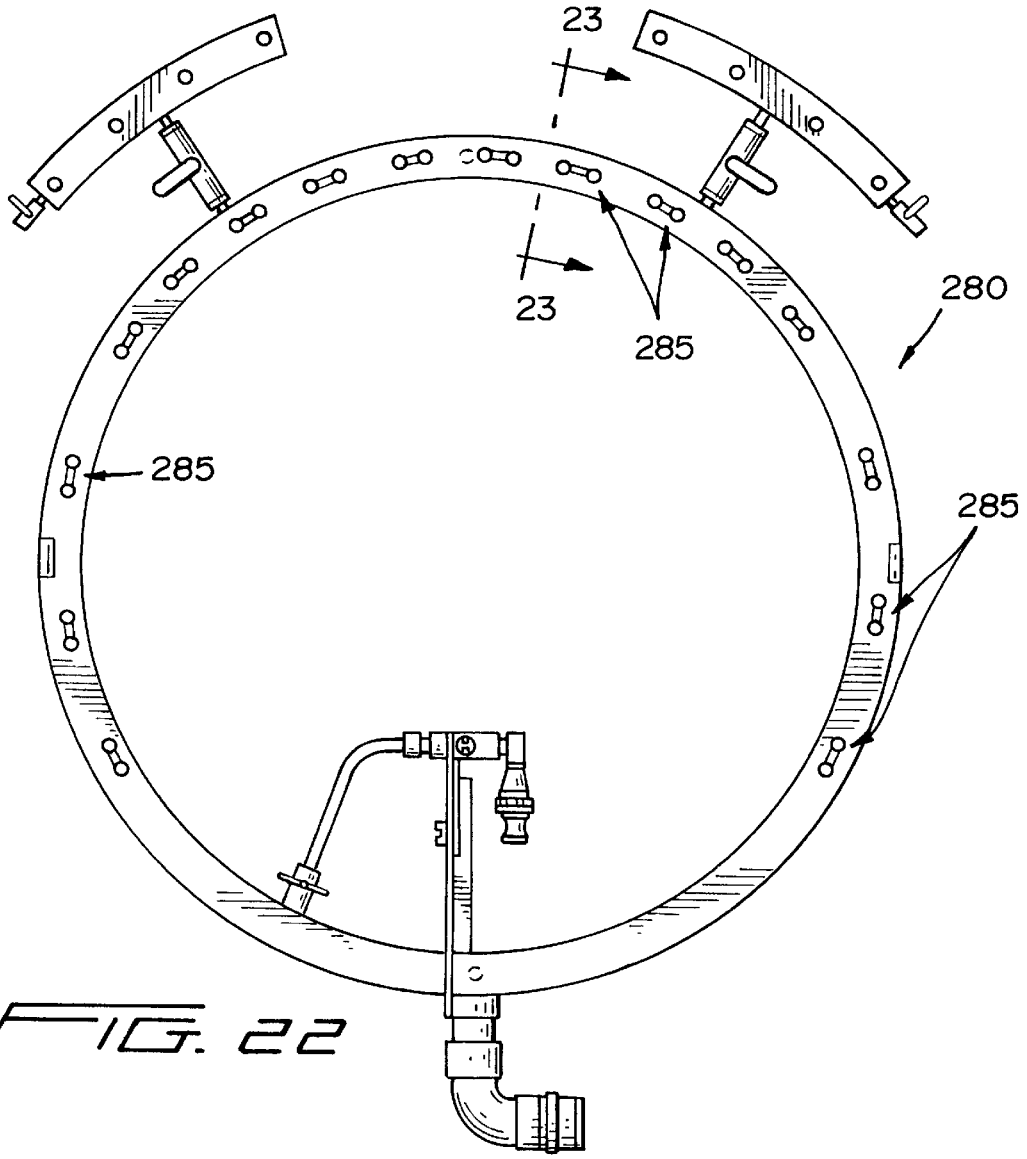
FIG. 22 is a front elevational view of another water manifold similar to the water manifolds of FIGS. 3, 13, 16 and 18, and illustrates a plurality of pairs of manually valved nozzles associated with the water manifold.
Figure 23:
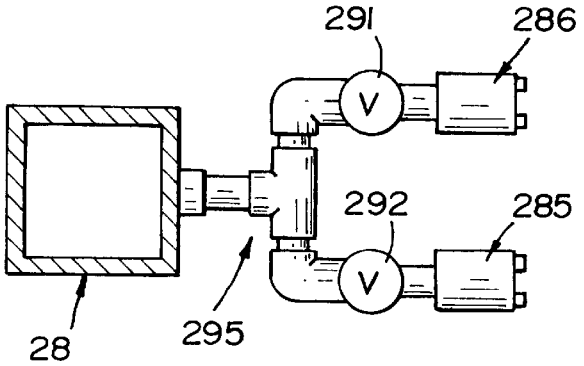
FIG. 23 is a side elevational view of a portion of the water manifold of FIG. 22, and illustrates a generally Y-shaped conduit having a leg connected to the water manifold and a pair of arms each carrying a valve and a spray nozzle with the orifices of the nozzles differing in size.

A final water manifold constructed in accordance with this invention is illustrated in FIGS. 22 and 23 of the drawings and is generally designated by the reference numeral 280.

The water manifold 280 is essentially identical to the water manifolds 70, 70' except the respective primary nozzles 80, 92 have been replaced by sixteen tandem pairs 285 of nozzles 286 having small discharge orifices (not shown) and nozzles 287 having larger discharge orifices (not shown). The nozzles 286, 287 are each controlled by respective manual valves 291, 292, respectively, each in an arm (unnumbered) of a generally Y-shaped tubular fitting 295 which is carried by and placed in fluid communication with the water manifold 280. When the valves 291 and 292 are respectively opened and closed, a fine spray will be emitted from the smaller discharge orifices of the nozzles 286 and vice versa. Obviously, in this embodiment of the invention both valves 291 and 292 can be opened different amounts depending upon ambient snow making conditions.

Figure 8:
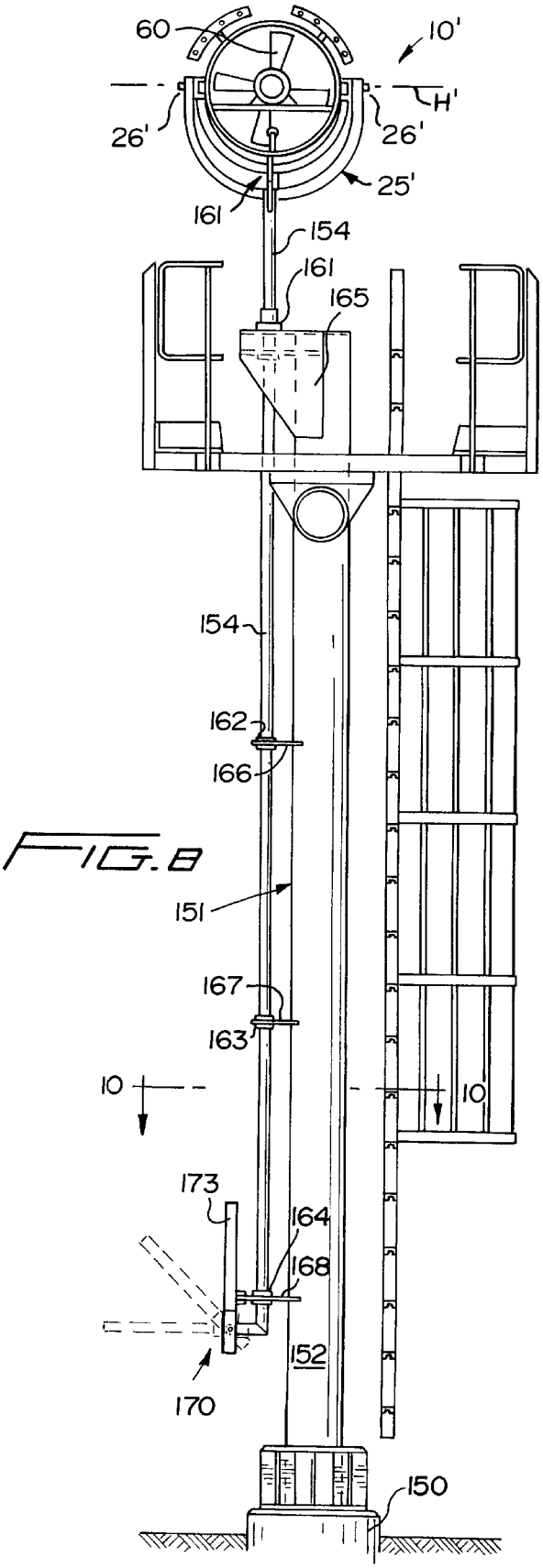
FIG. 8 is a side elevational view of another snow making apparatus or snow gun constructed in accordance with this invention, and illustrates a snow gun housing, fan and water manifold supported relative to a high tower and including manually operable mechanisms at a lower end portion of the tower for pivoting the snow gun housing about horizontal and/or vertical axes.
Figure 9:
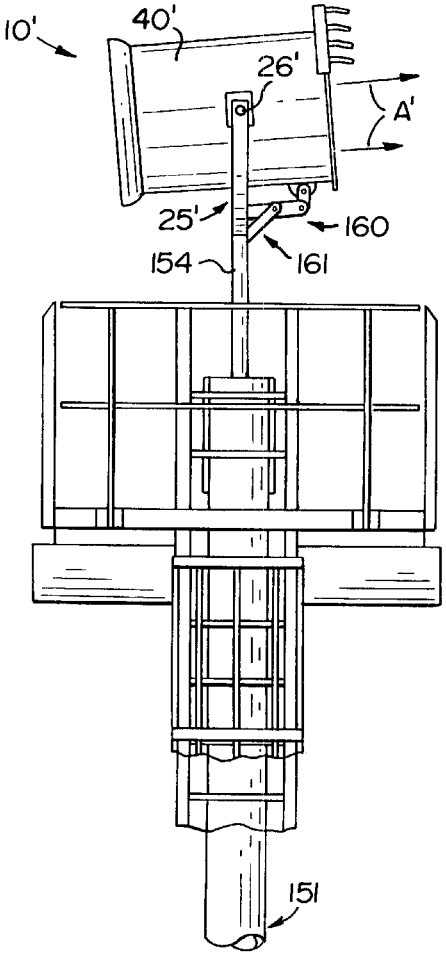
FIG. 9 is a fragmentary side elevational view of the snow making gun of FIG. 8, and illustrates a linkage mechanism for selectively adjusting the housing of the snow gun for pivoting movement about a horizontal axis.

In lieu of the pivoting handle 173 of the adjustment effecting mechanism 170 of FIGS. 8 and 10, in further accordance with this invention the handle 173 and the pivot 175 is eliminated and the tube 171 is replaced by a longer tube which forms a "handle" disposed normal to the tube 154. The slots 172 are replaced by holes disposed in an arcuate configuration. A plate similar to the plate 164 is welded to the "handle" 171 and this plate includes similar holes arranged on an arc corresponding to the holes in the plate 168. In any position of relatively arcuate adjustment, a pin can be dropped through the aligned holes of the two plates to maintain the housing 40' in a desired position of rotation about the vertical axis of the column 154.

Although a preferred embodiment of the invention has been specifically illustrated and described herein, it is to be understood that minor variations may be made in the apparatus without departing from the spirit and scope of the invention, as defined the appended claims.

We claim:

1. Apparatus for making snow comprising means for defining a housing, means for generating an air current relative to said housing, means for defining a first water manifold, means for defining a second water manifold, said first and second water manifolds including respective first and second means for alternatively spraying water from said respective first and second water manifolds toward the generated air current whereby the water and air admix and form snow under respective first and second different ambient conditions, said first and second water spraying means include respective first and second spray nozzles having different size orifices, means for alternatively removably securing said first and second water manifolds relative to said housing whereby said first water manifold and said first water spraying means can be removed from said housing and replaced by said second water manifold and said second water spraying means to accommodate said second ambient conditions, means for accurately alternatively locating said first and second water manifolds relative to said housing, and said locating means includes a locating pin.

2. Apparatus for making snow comprising means for defining a housing, means for generating an air current relative to said housing, means for defining a first water manifold, means for defining a second water manifold, said first and second water manifolds including respective first and second means for alternatively spraying water from said respective first and second water manifolds toward the generated air current whereby the water and air admix and form snow under respective first and second different ambient conditions, said first and second water spraying means include respective first and second spray nozzles having different size orifices, means for alternatively removably securing said first and second water manifolds relative to said housing whereby said first water manifold and said first water spraying means can be removed from said housing and replaced by said second water manifold and said second water spraying means to accommodate said second ambient condition, and first and second substantially spaced means for accurately alternatively locating said first and second water manifolds relative to said housing.

3. Apparatus for making snow comprising means for defining a housing, means for generating an air current relative to said housing, means for defining a first water manifold, means for defining a second water manifold, said first, and second water manifolds including respective first and second means for alternatively spraying water from said respective first and second water manifolds toward the generated air current whereby the water and air admix and form snow under respective first and second different ambient conditions, said first and second water spraying means include respective first and second spray nozzles having different size orifices, means for alternatively removably securing said first and second water manifolds relative to said housing whereby said first water manifold and said first water spraying means can be removed from said housing and replaced by said second water manifold and said second water spraying means to accommodate said second ambient conditions, and first and second substantially diametrically opposite means for accurately locating said water manifold relative to said housing.

4. A manifold for a snow making machine comprising means for defining a removable substantially arcuate water chamber, a plurality of nozzles each including an orifice of a predetermined size, said plurality of nozzles being in fluid communication with said water chamber, means for accurately arcuately locating said water chamber defining means relative to a snow making machine housing from which an air current is adapted to emanate, and cooperative first and second quick connect and disconnect clamping means carried by said respective water chamber means and said housing for quick connecting and disconnecting said water chamber means relative to said housing during the accurate arcuate locating thereof by said accurately arcuately locating means.

5. The snow making machine manifold as defined in claim 4 including means carried by said water chamber means for directing a nucleating air/water admixture toward an air current for facilitating the creation of snow.

6. The snow making machine manifold as defined in claim 4 wherein said water chamber means is of an at least partially annular configuration.

7. The snow making machine manifold as defined in claim 4 wherein said water chamber means is of a generally annular configuration.

8. The snow making machine manifold as defined in claim 4 wherein said locating means are a pair of substantially spaced locating elements.

9. The snow making machine manifold as defined in claim 8 including means carried by said water chamber means for directing a nucleating air/water admixture toward an air current for facilitating the creation of snow.

10. The snow making machine manifold as defined in claim 9 wherein said water chamber means is of an at least partially annular configuration.

11. The snow making machine manifold as defined in claim 8 wherein said water chamber means is of an at least partially annular configuration.

12. The snow making machine manifold as defined in claim 4 wherein said locating means are a pair of substantially spaced locating pins.

13. The snow making machine manifold as defined in claim 4 wherein said locating means are a pair of substantially diametrically spaced locating elements.

14. The snow making machine manifold as defined in claim 4 wherein said locating means are a pair of substantially diametrically spaced locating pins.

15. Apparatus for making snow comprising as for defining a housing, means for generating an air current relative to said housing, means for defining a water manifold, said water manifold including means for spraying water from said water manifold toward the generated air current whereby the water and air admix and form snow under first ambient conditions, means for removably securing said water manifold relative to said housing whereby said water manifold can be removed from said housing, said removably securing means including cooperative first and second substantially spaced first and second clamping means carried one each by said housing and said manifold, and means for accurately locating said water manifold relative to said housing.

16. The apparatus as defined in claim 15 wherein said accurately locating means include first and second substantially spaced means for accurately locating said water manifold relative to said housing.

17. Apparatus for making snow comprising means for defining a housing, means for generating an air current relative to said housing, means for defining a water manifold, said water manifold including means for spraying water from said water manifold toward the generated air current whereby the water and air admix and form snow under first ambient conditions, means for removably securing said water manifold relative to said housing whereby said water manifold can be removed from said housing, said removably securing means including cooperative first and second substantially spaced first and second clamping means carried one each by said housing and said manifold, and said first and second clamping means are substantially spaced from each other.

18. The apparatus as defined in claim 17 including first and second substantially spaced means for accurately locating said water manifold relative to said housing.

19. The apparatus as defined in claim 18 wherein said first and second clamping means and said first and second locating means are disposed in alternating relationship to each other.

20. Apparatus for making snow comprising means for defining a housing, means for generating an air current relative to said housing, means for defining a water manifold, said water manifold including means for spraying water from said water manifold toward the generated air current whereby the water and air admix and form snow under first ambient conditions, means for removably securing at least a portion of said water manifold relative to said housing whereby said water manifold portion can be removed from said housing and replaced by another water manifold portion and associated other water spraying means to accommodate second ambient conditions differing from the first ambient conditions, said water manifold including a generally annular water chamber, and said water manifold portion being a removable annular front plate of said annular water chamber carrying said first-mentioned water spraying means.

21. Apparatus for making snow comprising means for defining a housing, means for generating an air current relative to said housing, means for defining a water manifold, said water manifold including means for spraying water from said water manifold toward the generated air current whereby the water and air admix and form snow under first ambient conditions, said water manifold means including a plurality of first and second orifices of different sizes disposed in alternating relationship along said water manifold, and valve means for substantially simultaneously opening the first plurality of orifices and closing the second plurality of orifices in respective first and second positions thereby accommodating at least two different ambient conditions to optimize snow making.

22. The snow making apparatus as defined in claim 21 wherein said valve means is a selectively apertured valve plate operative (a) in a first position in which the valve plate apertures are aligned to communicate only with the first plurality of orifices while closing the second plurality of orifices, and (b) in a second position in which the valve plate apertures are aligned to communicate only with the second plurality of orifices while closing the first plurality of orifices.

23. Apparatus for making snow comprising means for defining a housing, means for generating an air current relative to said housing, means for defining a water manifold, said water manifold including means for spraying water from said water manifold toward the generated air current whereby the water and air admix and form snow under first ambient conditions, said water spraying means including a first plurality of spray nozzles and a second plurality of spray nozzles having respective first and second different sized orifices to optimize snow making under different ambient conditions, valve means selectively operable for at least opening said first orifices and closing said second orifices and vice versa, and means for selectively blowing air through said first and second orifices to rid the same of water and thereby prevent freeze-up during transition usage under changing ambient conditions.

24. A method of making snow under differing ambient conditions comprising the steps of creating air flow along a substantially unidirectional path of travel, creating a first water spray from a first water source with the first water spray having an upstream initiation end of a predetermined cross-sectional size, directing a downstream end portion of the first water spray toward the air flow for admixture therewith whereby snow is made under first ambient conditions, terminating the first water spray and displacing the first water source from the air flow path of travel, creating a second water spray from a second water source with the second water spray having an upstream initiation end of a predetermined cross-sectional size differing from the predetermined cross-sectional size of the first water spray, and directing a downstream portion of the second water spray toward the air flow for admixture therewith whereby snow is made under second ambient conditions differing from the first ambient conditions.

25. The method as defined in claim 24 wherein the second water source under the second ambient conditions occupies the space occupied by the first water source prior to the displacement thereof.

26. A method of making snow under differing ambient conditions comprising the steps of creating air flow along a substantially unidirectional path of travel, creating a first water spray from a first water source with the first water spray having an upstream initiation end of a predetermined cross-sectional size, directing a downstream end portion of the first water spray toward the air flow for admixture therewith whereby snow is made under first ambient conditions, terminating the first water spray, creating a second water spray having an upstream initiation end of a predetermined cross-sectional size differing from the predetermined cross-sectional size of the first water spray, and directing a downstream portion of the second water spray toward the air flow for admixture therewith whereby snow is made under second ambient conditions differing from the first ambient conditions.

27. The method as defined in claim 26 including the steps of creating the first water spray from a first water source and creating the second water spray from a second water source.

28. The method as defined in claim 26 including the steps of creating the first water spray through a first orifice of a predetermined cross-sectional size, creating the second water spray through a second orifice of a second predetermined cross-sectional size differing from that of the first orifice, and blowing air through the first orifice after performing the first water spray terminating step to rid the first orifice of water and thereby prevent orifice freeze-up.

29. The method as defined in claim 28 including the steps of creating the first water spray from a first water source and creating the second water spray from a second water source.

30. The method as defined in claim 29 including the step of displacing the first water source from the air flow path of travel subsequent to first spray termination, and positioning the second water source in the space originally occupied by the first water source under the second ambient conditions.

* * * * *